US008546674B2

(12) United States Patent
Kurihara et al.

(10) Patent No.: US 8,546,674 B2
(45) Date of Patent: Oct. 1, 2013

(54) SOUND TO LIGHT CONVERTER AND SOUND FIELD VISUALIZING SYSTEM

(75) Inventors: Makoto Kurihara, Hamamatsu (JP); Junichi Fujimori, Hamamatsu (JP)

(73) Assignee: Yamaha Corporation (JP)

( * ) Notice: Subject to any disclaimer, the term of this patent is extended or adjusted under 35 U.S.C. 154(b) by 28 days.

(21) Appl. No.: 13/232,610

(22) Filed: Sep. 14, 2011

(65) Prior Publication Data

US 2012/0097012 A1 Apr. 26, 2012

(30) Foreign Application Priority Data

Oct. 22, 2010 (JP) ..... 2010-238032

(51) Int. Cl.
*A63J 17/00* (2006.01)
*A63J 5/10* (2006.01)
*G10H 1/00* (2006.01)

(52) U.S. Cl.
USPC ..... 84/464 R

(58) Field of Classification Search
USPC ..... 84/464 R, 464 A
See application file for complete search history.

(56) References Cited

U.S. PATENT DOCUMENTS 4,252,048 A * 2/1981 Pogoda ..... 84/454
4,262,338 A * 4/1981 Gaudio, Jr. ..... 345/532
4,753,148 A * 6/1988 Johnson ..... 84/464 R
4,962,687 A * 10/1990 Belliveau et al. ..... 84/464 R
7,274,160 B2 * 9/2007 Mueller et al. ..... 315/312
7,309,965 B2 * 12/2007 Dowling et al. ..... 315/318
7,767,893 B2 * 8/2010 Hansel et al. ..... 84/464 R

OTHER PUBLICATIONS

Mizuno, Keiichiro, "Visualization of Noise", Souon Seigyo, vol. 22, No. 1 (1999), pp. 20-23, English translation provided.

Nishida, et al., "Photographical Sound Visualization Method by Using Light Emitting Diodes", The Japan Society of Mechnical Engineers, pp. 223-227, English abstract provided.

* cited by examiner

*Primary Examiner* — Jeffrey Donels

(74) *Attorney, Agent, or Firm* — Rossi, Kimms & McDowell LLP

(57) ABSTRACT

An object is to readily visualize a propagation state of sound emitted within a sound space. A sound to light converter includes: a microphone; a light emitting unit; and a light emission control unit that acquires an instantaneous value of an output signal from the microphone in synchronization with a strobe signal and that allows the light emitting unit to emit light with a luminance level corresponding to the acquired instantaneous value. The strobe signal is generated and output in a signal generator of the sound to light converter. Alternatively, the strobe signal is generated and output in a control device of a sound field visualizing system in synchronization with an emission of sound to be visualized by the sound to light converter.

20 Claims, 10 Drawing Sheets

SOUND TO LIGHT CONVERTER AND SOUND FIELD VISUALIZING SYSTEM

BACKGROUND OF THE INVENTION

1. Field of the Invention

The present invention relates to a technology of visualizing a sound field.

2. Description of the Related Art

Up to now, there have been proposed various technologies for visualizing a sound field (for example, refer to Non-patent documents 1 and 2). Non-patent document 1, Kohshi Nishida, Akira Maruyama, "A Photographical Sound Visualization Method by Using Light Emitting Diodes", Transactions of the Japan Society of Mechanical Engineers, Series C, Vol. 51, No. 461 (1985) discloses that one microphone is moved vertically and laterally within a sound space, sound pressures at a plurality of places are sequentially measured, and a light emitter such as a light emitting diode (LED) emits a light with luminance corresponding to the sound pressure, thereby visualizing the sound field. On the other hand, Non-patent document 2, Keiichiro Mizuno, "Souon no kashika", Souon Seigyo, Vol. 22, No. 1 (1999) pp. 20-23 discloses that a plurality of microphones are arranged within the sound space where a sound to be visualized is emitted to measure a sound pressure, a measurement result is tallied by a computer device, and a sound pressure distribution in the sound space is graphed and displayed on a display device.

The technology of visualizing a sound field performs a crucial function when grasping a noise distribution, for example, in rail cars or on airplanes and taking measures against noise. However, the purposes expected for the availability of the technology of visualizing the sound field are not limited to the use of analysis or reduction of the noise transmitted to the interior of the rail cars or the airplanes. In recent years, the availability of the sound field visualizing technique is expected for control of more soothing heard sound. For example, with the popularization of home audio devices with high performance which are represented by home theater, there is an increased need to use the sound field visualizing technology for the purpose of laying out the audio devices or adjusting the gains. The sound visualizing technology is expected to satisfy such a need. This is because if the sound pressure distribution of sound emitted into a sound space such as a living room, or a transition thereof (that is, a propagation state of sound wave) can be visualized, the layout position and the gain of the audio device can be appropriately adjusted so as to obtain a desired propagation state while visually confirming the propagation state, and it is expected that even end users having no specialized knowledge about audio can readily optimize the layout position of the audio device. Also, the sound field visualizing technology is expected to be applied to an intended purpose for reducing sound interferences called "flutter echo" or "booming" in the sound space such as a conference room or an instrument training room. Further, the sound field visualizing technology is also expected to be effective as a way for presenting a product test of a sounding body such as an instrument or a speaker (for example, a test of whether the instrument plays the sound as planned, or not), the design assistance, or the acoustic performance of products to the end user.

However, in the technology disclosed in Non-patent document 1 mentioned above, because one microphone is moved within the sound space to sequentially measure the sound pressure, the sound pressures at the plurality of places cannot be visualized at the same time (that is, the sound pressure distribution within the sound space cannot be visualized). On the other hand, in the technology disclosed in Non-patent document 2 mentioned above, although an instantaneous propagation state of sound in the sound space can be visualized, a computer device that tallies and graphs the sound pressures measured by the respective microphones is required, resulting in a large-scale system. For that reason, there arises such a problem that this technology cannot be readily used at home. Also, as in the technology disclosed in Non-patent document 2 mentioned above, the technology by which the sound field is visualized by the aid of the plurality of microphones (or a microphone array configured by the plurality of microphones) allows, in addition to a problem that the entire system is complicated, a problem that an influence of the installation of the microphones on the sound field (an influence of a main body of the microphone array, or an influence of a wiring between the microphone array and a signal processing device) is large. The technology also allows a problem that there is a need to acquire positional information representative of the layout positions of the respective microphones through another method, a problem that the expansion of the number of channels which has been decided once is difficult, and a problem that because there is a need to display the results collected by the microphones on another display device, the simultaneity and real time property of the positional information are lost so that the sound field cannot be instinctually visualized.

SUMMARY OF THE INVENTION

The present invention has been made in view of the above problems, and therefore aims at providing a technology that enables a propagation state of sound emitted into a sound space to be readily visualized.

An aspect of the present invention provides a sound to light converter including: a microphone; a light emitting unit; and a light emission control unit that acquires an instantaneous value of an output signal from the microphone in synchronization with a strobe signal and that allows the light emitting unit to emit light with a luminance level corresponding to the acquired instantaneous value.

The sound to light converter may further include a signal generator that generates and outputs the strobe signal.

Further, a sound field visualizing system in which the sound to light converter is disposed may be configured to be provided with a control device that generates and outputs the strobe signal in synchronization with an emission of sound to be visualized by the sound to light converter.

When a plurality of sound to light converters are installed at positions different from each other within the sound space into which the sound to be visualized is emitted, an instantaneous value of the output signal from the microphone is acquired in synchronization with the strobe signal output from the control device in synchronization with the emission of sound to be visualized, and processing for allowing the light emitting unit to emit light with a luminance level corresponding to the instantaneous value is executed by each of the sound to light converters. For that reason, it is considered that a square wave signal is used as the strobe signal, the light emission control unit included in each of the plurality of sound to light converters acquires the instantaneous value of the output signal from the microphone in synchronization with a rising edge or a falling edge of the strobe signal, and the control device changes a rising cycle of the strobe signal according to user's operation or with time. With this configuration, the sound pressure distribution of sound to be visualized within the sound space and a change in the sound pressure distribution with time passage can be visually grasped by a user.

DESCRIPTION OF EMBODIMENTS

Hereinafter, embodiments of the present invention will be described with reference to the accompanying drawings.

A: First Embodiment

Figure 1:
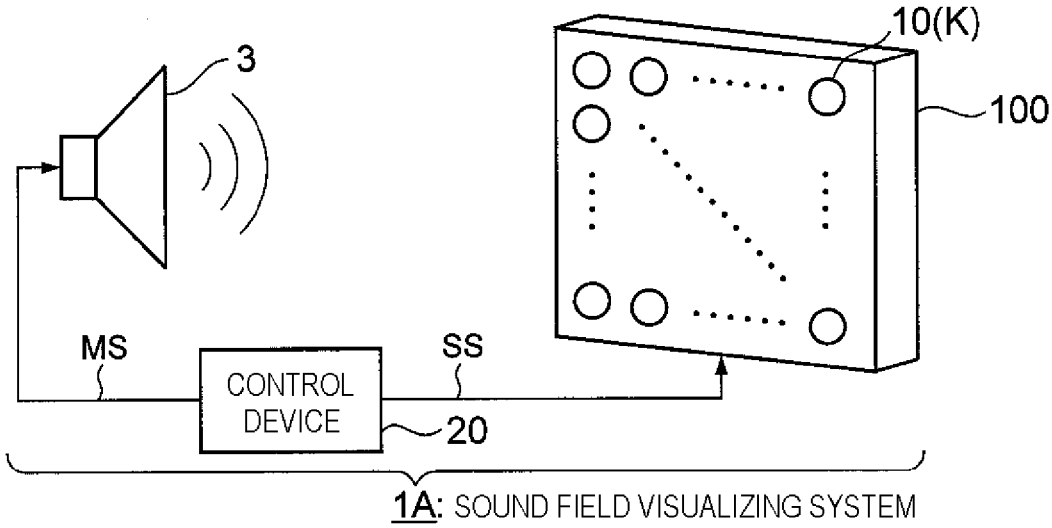
FIG. 1 is a block diagram illustrating a configuration example of a sound field visualizing system 1A according to a first embodiment of the present invention.

FIG. 1 is a block diagram illustrating a configuration example of a sound field visualizing system 1A according to a first embodiment of the present invention. As illustrated in FIG. 1, the sound field visualizing system 1A includes a sound to light converter array 100, a control device 20, and a sound source 3. The sound to light converter array 100, the control device 20, and the sound source 3, which configure the sound field visualizing system 1A, is installed in a sound space such as a living room in which a home theater is set up. In the sound field visualizing system 1A, the sound source 3 is allowed to emit a sound wave under the control of the control device 20, and a propagation state of a specific wave front of the sound wave is visualized by the sound to light converter array 100.

The sound to light converter array 100 is configured such that sound to light converters 10 (k; k=1 to N, N is an integer of 2 or more) are arranged in a matrix. A strobe signal SS (a square wave signal in this embodiment) is supplied from the control device 20 to each sound to light converter 10(*k*) configuring the sound to light converter array 100. Each sound to light converter 10(*k*) measures an instantaneous value of a sound pressure at a layout position thereof at that time in synchronization with a rising edge of the strobe signal SS, and executes a process of emitting a light with a luminance level corresponding to the instantaneous value until a subsequent strobe signal SS rises. In this embodiment, a description will be given of a case in which the sound pressure is measured in synchronization with the rising edge of the strobe signal SS. Alternatively, the above process may be executed in synchronization with a falling edge of the strobe signal SS, or the sound pressure may be measured in synchronization with an arbitrary timing other than the rising edge (or the falling edge) of the strobe signal SS. For example, when a square wave signal is used as the strobe signal SS, the sound pressure is measured when a given waveform pattern (for example, 0101) appears. Also, although the square wave signal is used as the strobe signal SS in this embodiment, a chopping signal or a sinusoidal signal may be used as the strobe signal SS.

Figure 2:
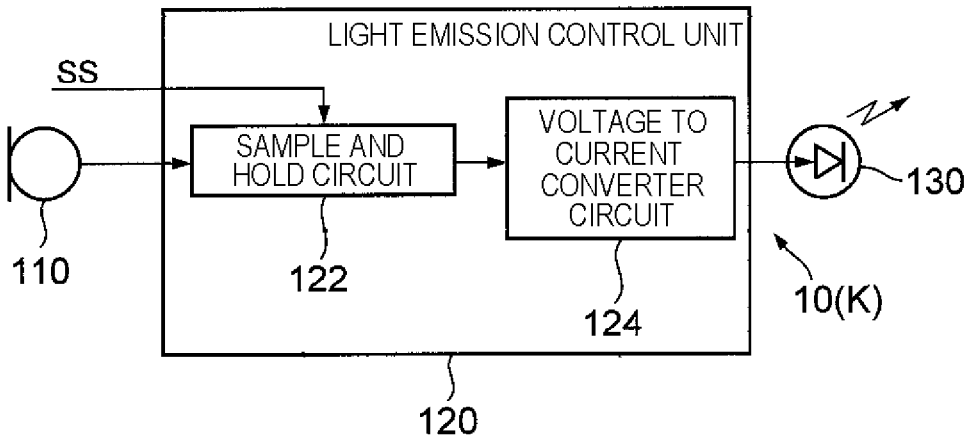
FIG. 2 is a diagram illustrating a configuration example of a sound to light converter 10(*k*).

FIG. 2 is a block diagram illustrating a configuration example of the sound to light converter 10(*k*). As illustrated in FIG. 2, each sound to light converter 10(*k*) includes a microphone 110, a light emission control unit 120, and a light emitting unit 130. Although not shown in detail in FIG. 2, the sound to light converter 10(*k*) is configured such that the respective components illustrated in FIG. 2 are integrated together on a board having each side of about 1 cm (the same is applied to sound to light converters in other embodiments). The microphone 110 is configured by, for example, a MEMS (micro electro mechanical systems) microphone or a downsized ECM (electret condenser microphone), and outputs a sound signal representative of a waveform of a collected sound. As illustrated in FIG. 2, the light emission control unit 120 includes a sample and hold circuit 122 and a voltage to current converter circuit 124. The sample and hold circuit 122 and the voltage to current converter circuit 124 are configured as well known. The sample and hold circuit 122 samples the sound signal output from the microphone 110 with the rising edge of the strobe signal SS as a trigger, holds the sampled instantaneous value (voltage) until the strobe signal SS subsequently rises, and applies the voltage to the voltage to current converter circuit 124. When the sound pressure is measured in synchronization with the falling edge of the strobe signal SS, the sound signal output from the microphone 110 may be sampled with the falling edge of the strobe signal SS as a trigger, and a process of holding the sampling result until the strobe signal SS subsequently falls may be executed by the sample and hold circuit 122. Whether the sound signal is sampled with the rising edge of the strobe signal SS as a trigger, or with the falling edge of the strobe signal SS as a trigger, may be set in advance at the time of shipping the sound to light converter array 100 from a factory.

The voltage to current converter circuit 124 generates a current of a value proportional to a voltage applied from the sample and hold circuit 122, and supplies the current to the light emitting unit 130. The light emitting unit 130 is configured by, for example, a visible light LED, and emits a visible light with a luminance level corresponding to the amount of the current supplied from the voltage to current converter circuit 124. A user of the sound field visualizing system 1A visually observes the distribution of the light emission luminance of the light emitting unit 130 of each sound to light converter 10(*k*) in the sound to light converter array 100 and a change of the distribution with time passage, thereby enabling the propagation state of the specific wave front of the sound wave emitted from the sound source 3 to be visually grasped.

The control device 20 is connected to each sound to light converter 10(*k*) and the sound source 3 through signal lines, or the like, and controls the operation the sound to light converter 10(*k*) and the sound source 3. When an instruction for operation start is conducted on an operating unit not shown, the control device 20 outputs a drive signal MS for driving the sound source 3, and also outputs (allows the rising of) the strobe signal SS in synchronization with the output of the drive signal MS. In this embodiment, a description will be given of a case in which the strobe signal SS is allowed to rise to instruct the sound to light converter 10(*k*) to sample the instantaneous value of the sound pressure. Alternatively, the strobe signal SS may be allowed to fall to instruct the sound to light converter 10(*k*) to sample the instantaneous value of the sound pressure.

Figure 3A:
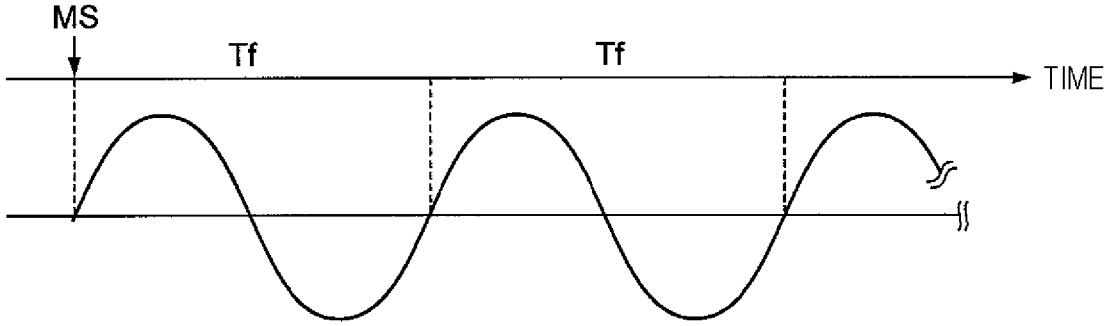
FIGS. 3A and 3B are diagrams illustrating the operation of a control device 20 included in the sound field visualizing system 1A.
Figure 3B:
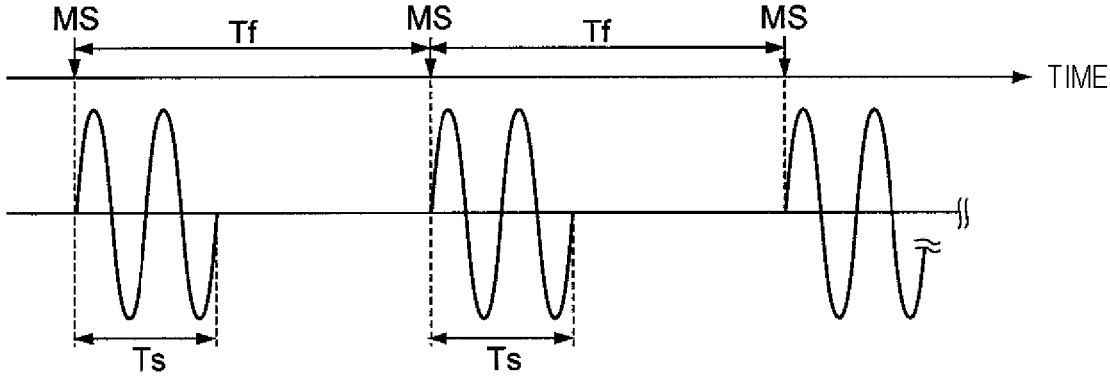

There are conceived various modes as to what sound is emitted by the sound source 3 according to the drive signal MS. For example, when a steady sound is to be visualized, a sound having a sound waveform of a sinusoidal wave as illustrated in FIG. 3A may be continuously emitted by the sound source 3. Also, when a burst sound is to be visualized, the control device 20 may be allowed to output the drive signal MS in a constant cycle (FIG. 3B exemplifies a case having the same cycle Tf as that of the sinusoidal wave signal illustrated in FIG. 3A, but the cycle may be different from that of the sinusoidal wave signal). On the other hand, the sound source 3 may be allowed to emit sound for a time length Ts (Ts<Tf) upon receiving the drive signal MS, and after the time Ts has been elapsed, the sound source 3 may stop the sound emission until receiving a subsequent drive signal MS. In the mode in which the burst sound is sequentially emitted as illustrated in FIG. 3B, for the purpose of preventing the wave front of the sound emitted previously from being visualized by echo in the sound space into which the sound to be visualized is emitted, there is a need to determine the time length Ts of a sound interval and an output cycle (Tf in an example of FIG. 3B) of the drive signal MS so that an energy of the sound wave output from the sound source 3 in the sound interval Ts is sufficiently attenuated within a silent interval of a time length Tf−Ts. Also, the burst sound may be replaced with a pulse sound.

The feature of this embodiment resides in that the control device 20 is allowed to output the strobe signal SS in synchronization with the output of the drive signal MS. There are conceived various modes as to the output of the strobe signal SS, and how to synchronize the output of the strobe signal SS with the output of the drive signal MS. Specifically, as illustrated in FIG. 4A, there are conceived a mode in which the strobe signal SS is allowed to rise in synchronization with the output of the drive signal MS only once, and modes in which the strobe signal SS is allowed to rise several times as illustrated in FIGS. 4B and 4C.

Figure 4A:
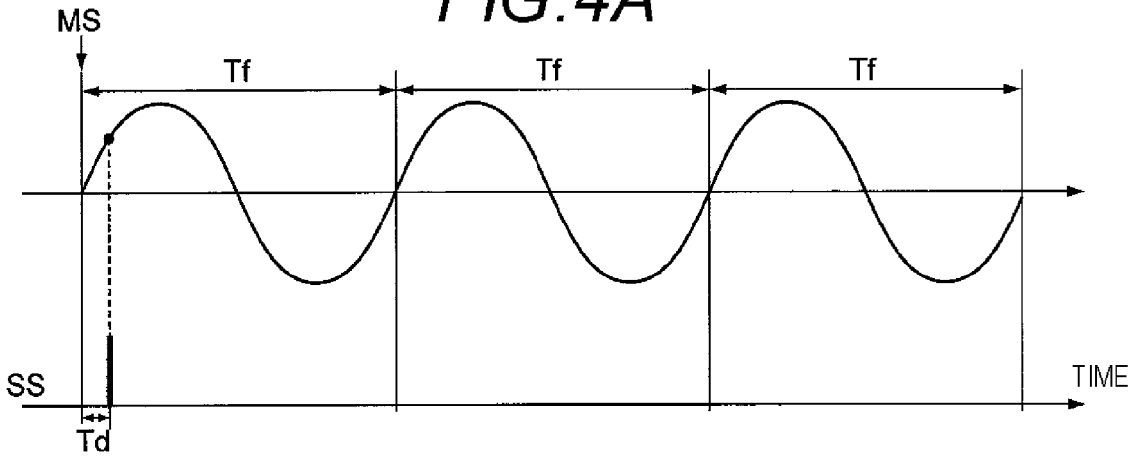
FIGS. 4A to 4C are diagrams illustrating an output mode of a strobe signal SS output from the control device 20.

FIG. 4A exemplifies a case in which the strobe signal SS is allowed to rise only once when a time Td has elapsed after starting the output of the drive signal MS that allows the sound source 3 to emit the steady sound (sound having a sound waveform represented by a sinusoidal wave of the cycle Tf). According to this configuration, in each sound to light converter 10(*k*), the instantaneous value of the sound pressure when the time Td has elapsed since the output of the drive signal MS is sampled, and the light emitting unit 130 emits light with a luminance level corresponding to the sampling result. As a result, an image (image such as a still picture) in which an instantaneous sound pressure distribution when only the time Td has elapsed since the emission start of the sound wave to be visualized is represented by the distribution of the light emission luminance of the light emitting unit 130 of each sound to light converter 10(*k*) is viewed by observer's eyes.

Figure 4B:
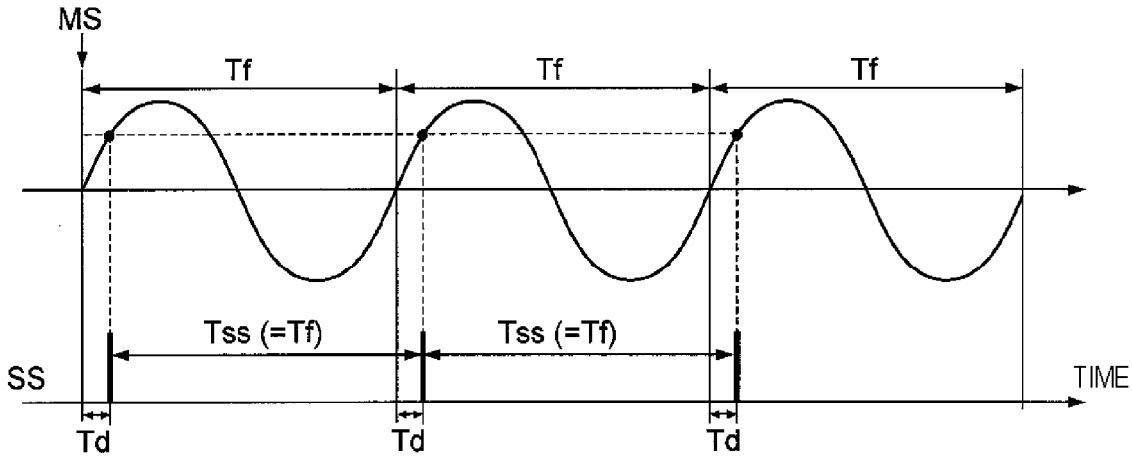
Figure 4C:
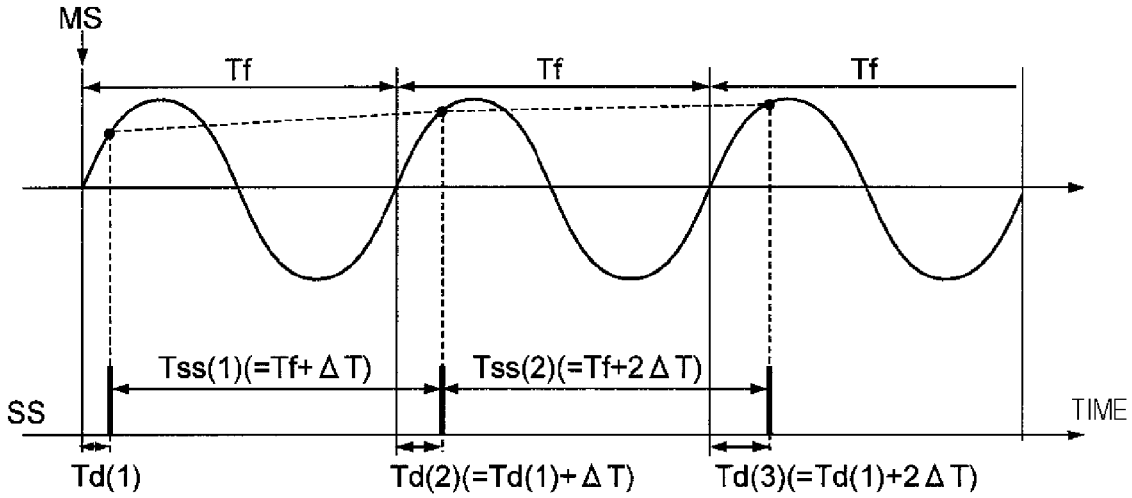

FIGS. 4B and 4C exemplify cases in which the strobe signal SS rises plural times when the sound source 3 is allowed to emit the steady sound. In more detail, FIG. 4B exemplifies a case in which the strobe signal SS rises in a constant cycle (in FIG. 4B, the same cycle as a cycle of the sound to be visualized), and FIG. 4C exemplifies a case in which time intervals at which the strobe signal SS rises are gradually lengthened. As illustrated in FIG. 4B, when a signal having the same cycle as the cycle of the sound to be visualized is used as the strobe signal SS, the image such as the above-mentioned still picture is obtained every time the strobe signal SS rises. On the contrary, when the cycle of the strobe signal SS does not match the cycle of the sound to be visualized, the propagation state of the wave front that propagates at the sound speed is reduced to a frame rate that can be observed by the eyes so as to be visualized. For example, when a frequency fobs (=1/Tf) of the sound wave to be visualized is 500 Hz, a signal of a frequency fstr (=1/Tss)=499 Hz is used as the strobe signal SS. As a result, the light emitting unit 130 of each sound to light converter 10(*k*) can blink at a frequency of fobs−fstr=1 Hz, and an appearance of blink of the light emitting unit 130 of each sound to light converter 10(*k*) can be grasped by the eyes. In this case, when it is assumed that sound speed V=340 m/s, an apparent sound speed V'=VX (fobs−fstr)/fobs=68 cm/s is satisfied, and observation is conducted as if a time axis were extended to 500 times. That is, a difference between the frequency fobs of the sound to be visualized and the frequency fstr of the strobe signal SS is appropriately adjusted with the result that the propagation state of the sound wave to be visualized can be observed with the appropriately extended time axis.

As illustrated in FIG. 4C, in a mode where the time intervals at which the strobe signal SS rises are not kept constant, the instantaneous value of the sound pressure is sampled in a state where the phase is shifted in sampling timings adjacent to each other, and the light emission luminance of the light emitting unit 130 in each sampling timing is different according to the phase shift. For example, as illustrated in FIG. 4C, in a mode in which the rising intervals of the strobe signal SS are lengthened by a given quantity ΔT at a time (in other words, the delay time Td is lengthened by the given quantity ΔT at a time in a manner that Td(1)→Td(2)=Td(1)+ΔT→Td(3)=Td(2)+ΔT . . . ), the propagation state is viewed by the observer's eyes as a moving picture in which the light emission luminance of each sound to light converter 10(*k*) changes for each frame, and the propagation state of the sound wave emitted from the sound source 3 into the sound space can be represented as slow motion of the speed ΔT. Thus, even if a rising interval Tss(k) (or a delay time Td(k): k is a natural number) of the strobe signal SS is appropriately adjusted, the propagation state of the sound wave to be visualized can be observed with the appropriately extended time axis.

Figure 5A:
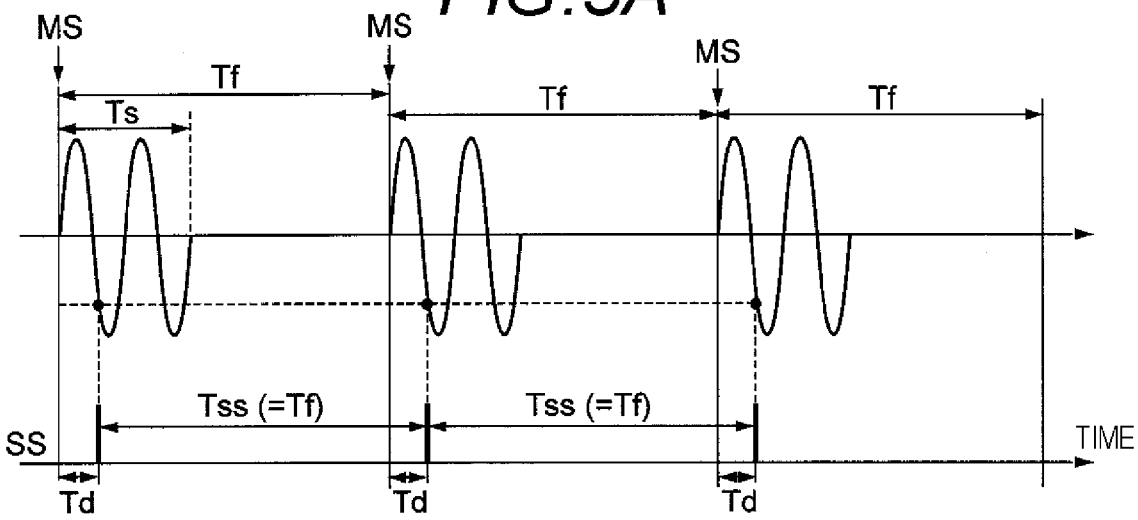
FIGS. 5A to 5C are diagrams illustrating the output mode of the strobe signal SS output from the control device 20.
Figure 5B:
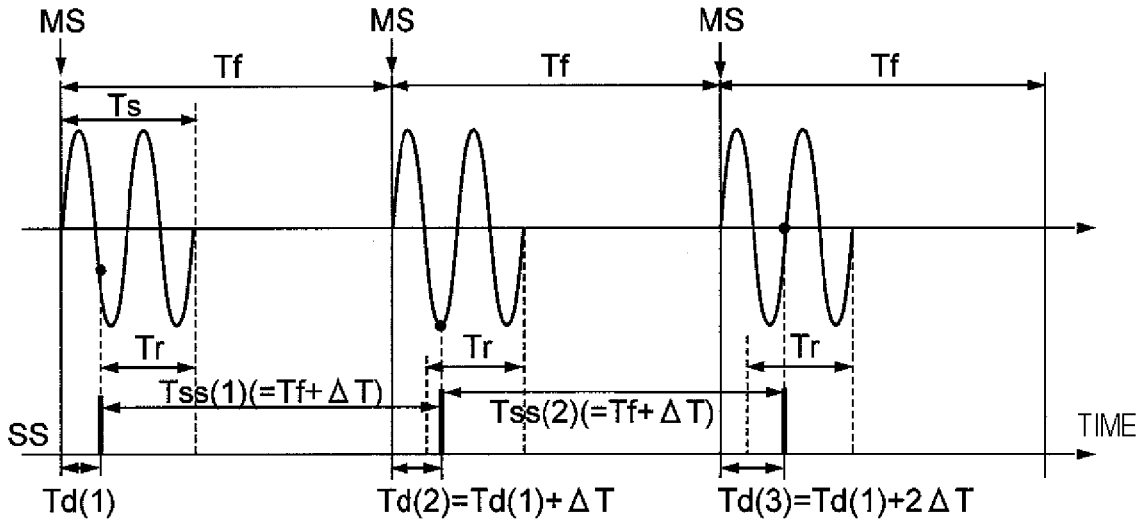
Figure 5C:
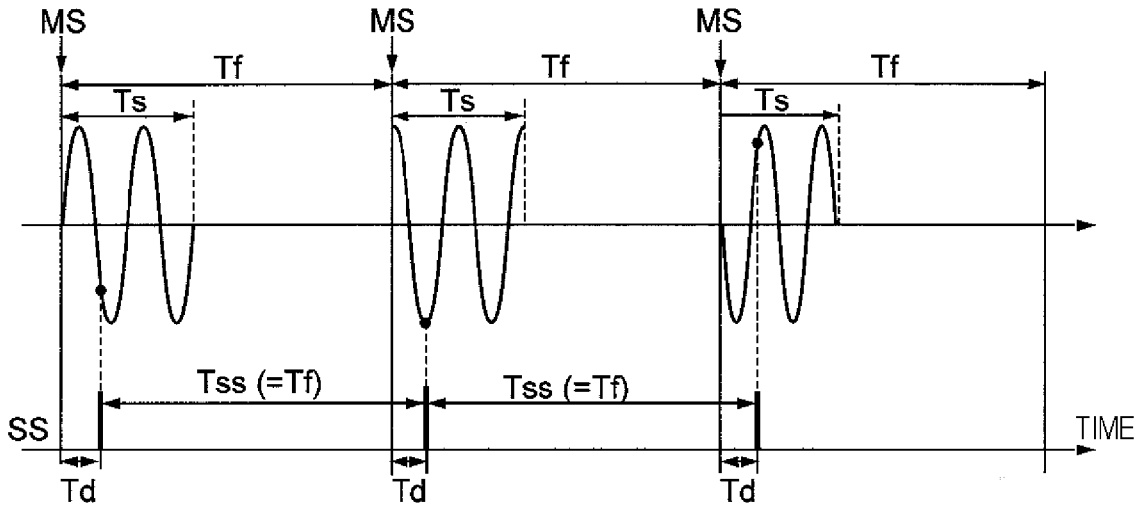

FIGS. 5A to 5C are diagrams illustrating the output modes of the strobe signal SS when the sound to be visualized is the burst sound (refer to FIG. 3B). In more detail, FIG. 5A exemplifies a case in which the strobe signal SS rises in a constant cycle (the same cycle as the output cycle Tf of the drive signal MS) from a time when only the time Td has elapsed since the output start of the drive signal MS as in FIG. 4B. In the mode of FIG. 5A, the instantaneous value of the sound pressure is always sampled at the same phase as in FIG. 4B, and the light emission luminance of the light emitting unit 130 of the sound to light converter 10(*k*) is identical with each other in each sampling timing. That is, in the mode illustrated in FIG. 5A, a still picture representative of the sound pressure distribution of a specific wave front of the burst sound wave is obtained in each rising timing of the strobe signal SS. When the strobe signal SS rises only once, the still picture representative of the sound pressure distribution in the rising timing of the specific wave front of the sound wave to be visualized is obtained as in FIG. 4A.

FIG. 5B exemplifies a case in which the rising cycle of the strobe signal SS is not kept constant (in the mode illustrated in FIG. 5B, the rising interval is lengthened by the given quantity ΔT at a time) as in FIG. 4C. In the mode illustrated in FIG. 5B, the instantaneous value of the sound is sampled in a state where the phase is shifted by a quantity corresponding to the time ΔT in the sampling timing adjacent to each other as in the mode illustrated in FIG. 4C. For that reason, for example, if the output cycle Tf of the drive signal MS is set to 1/30 which is the same as the frame rate of the general moving picture, the propagation state is viewed by the observer's eyes as a moving picture in which the light emission luminance of each sound to light converter 10(*k*) changes every 30 frames per one second, and the propagation state of the specific wave front of the burst sound wave emitted from the sound source 3 into the sound space can be visually grasped by the observer. The number of frames per one second may be larger than 30.

Also, if Td(1)=LL/V is set, and Td(k) (k is a natural number of 2 or more) is appropriately adjusted by the observer so as to fall within a given time interval Tr (time interval with a time when the time Td has elapsed since the output start of the drive signal MS as a start point and the termination of the sound interval Ts since the output start of the drive signal MS as an end point) by the operation of a manipulator disposed in the control device 20, the propagation state of the wave front substantially in a moment when the wave front arrives at a position apart from the sound source 3 by a distance LL is progressed or delayed so as to be observed. Also, as illustrated in FIG. 5C, the same advantage is obtained even if the phase when the burst sound wave is output according to the drive signal MS is changed manually or automatically. As illustrated in FIG. 5C, in the mode in which the phase when the burst sound wave is output according to the drive signal MS is varied, even if there is a limit in the fineness of the time resolution of the sample and hold circuit 122, if the phase can be finely controlled at the control device 20 side, the propagation state of the wave front of the burst sound wave can be visualized with the finer time resolution.

As described above, according to this embodiment, regardless of whether the sound to be visualized is the steady sound or the burst sound, the propagation state of the sound to be visualized can be visually grasped by the observer due to the space distribution of the light emission luminance (or a change in the space distribution with time passage) of each light emitting unit 130 of the sound to light converter 10(*k*) installed within the sound space.

Also, the sound field visualizing system 1A according to this embodiment does not include a computer device that tallies the sound pressures measured by the respective sound to light converters 10(*k*). The rising interval (or the delay time Td(k)) of the strobe signal SS is appropriately adjusted so that the propagation state of the sound wave to be visualized can be observed with the appropriately extended time axis. Therefore, a high-speed camera is not required. For that reason, the sound field visualizing system 1A is also suitable for a personal use in home, and can readily visualize the propagation state of the specific wave front of the sound emitted from an audio device disposed in a living room into the living room. The sound field visualizing system 1A is expected to be utilized for adjusting the layout position, the gain, and the speaker balance of the audio device.

Further, in this embodiment, because the strobe signal SS is output to the control device 20 in synchronization with the output of the drive signal MS, the wave front of the sound emitted by the sound source 3 according to the drive signal MS can be sampled with high precision, and the reproduction precision of the propagation state of the sound wave is also improved. Also, because a correspondence of the drive signal MS (that is, a signal for instructing the sound source 3 to start the emission of sound to be visualized) and the strobe signal SS is clear, there is no need to incorporate a mechanism (for example, PLL) that discriminates a phase difference and a trigger generator into each sound to light converter 10(*k*).

B: Second Embodiment

In the above-mentioned first embodiment, the plurality of sound to light converters 10(*k*) are arranged in a matrix to configure the sound to light converter array 100. Alternatively, each of the plural sound to light converters 10(*k*) included in the sound field visualizing system 1A may be disposed at a position different from each other within the sound space so as to visualize the propagation state of the sound wave emitted from the sound source 3. There are considered various modes of how to arrange the respective sound to light converters 10(*k*). Hereinafter, a description will be given of a specific arrangement mode of the sound to light converters 10(*k*) with reference to FIGS. 6A to 6C.

Figure 6A:
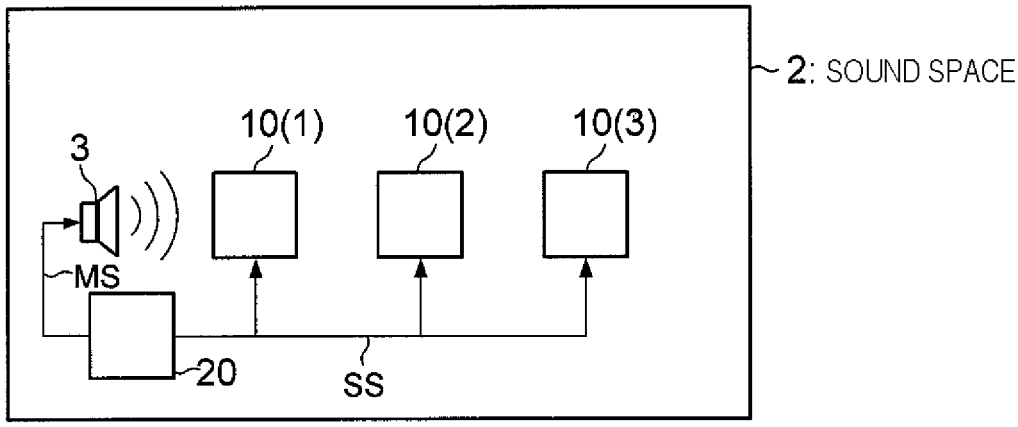
FIGS. 6A to 6C are diagrams illustrating a second embodiment of the present invention.
Figure 6B:
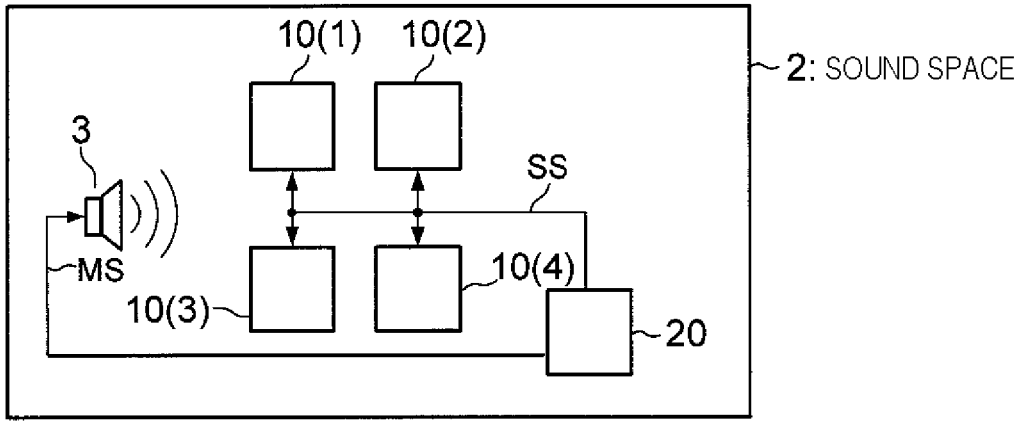
Figure 6C:
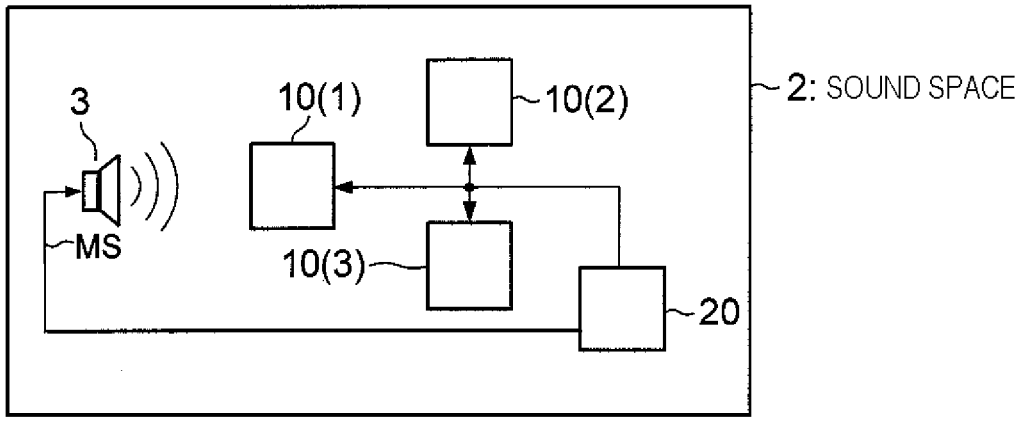

FIGS. 6A to 6C are overhead views of a sound space 2 in which the sound field visualizing system 1A is arranged, viewed from a ceiling of the sound space 2. FIG. 6A exemplifies a mode (hereinafter referred to as "one-dimensional layout mode") in which the sound source 3 and the respective sound to light converters 10(*k*) are linearly aligned on the same plane (for example, a floor surface of the sound space 2). FIGS. 6B and 6C each exemplify a mode (hereinafter referred to as "two-dimensional layout mode") in which the sound source 3 and the respective sound to light converters 10(*k*) are arrayed on the same plane, but all of the sound to light converters 10(*k*) are not linearly aligned. Also, there may be applied a mode in which the sound to light converters 10(*k*) are three-dimensionally arranged (for example, if the sound space 2 is cubic, the sound to light converters 10(*k*) are arranged at eight places in total, including the respective four corners of the floor and ceiling). The point is that an appropriate mode is selected from the one-dimensional, two-dimensional, and three-dimensional layout modes according to a direction of the sound source of the sound to be visualized, and the configuration and size of the sound space 2, and the sound to light converters 10(*k*) are arranged in the selected mode.

After the layout of the sound source 3 and the respective sound to light converters 10(*k*) has been completed, a user of the sound field visualizing system 1A connects the sound source 3 and the respective sound to light converters 10(*k*) to the control device 20 through communication lines, and conducts the operation of instructing the control device 20 to output the drive signal MS. The control device 20 starts the output of the drive signal MS according to the instruction given by the user, and starts the output of the strobe signal SS in synchronization with the output of the drive signal MS (for example, according to the output mode of FIG. 4B or FIG. 5A). Then, each of the sound to light converters 10(*k*) samples the sound pressure at each layout position in synchronization with the rising edge of the strobe signal SS, and allows the light emitting unit 130 to emit light with a luminance level corresponding to the sound pressure. For example, the sound to light converters 10(*k*) are one-dimensionally arranged so that the respective distances from the sound source 3 are longer in the stated order of the sound to light converter 10(1), the sound to light converter 10(2), and the sound to light converter 10(3) as illustrated in FIG. 6A. In this case, the respective light emitting units 130 of the sound to light converter 10(1), the sound to light converter 10(2), and the sound to light converter 10(3) emit the light with the luminance different according to the distances from the sound source 3 at a first rising time of the strobe signal SS. Thereafter, the respective light emission luminance is sequentially changed every time the strobe signal SS rises. The user of the sound field visualizing system 1A observes the change in the light emission luminance of the light emitting units 130 of the sound to light converters 10(*k*) arranged as illustrated in FIG. 6A with time. As a result, the user can instinctually and visually grasp the propagation state of the sound wave emitted from the sound source 3 into the sound space 2.

C: Third Embodiment

Figure 7:
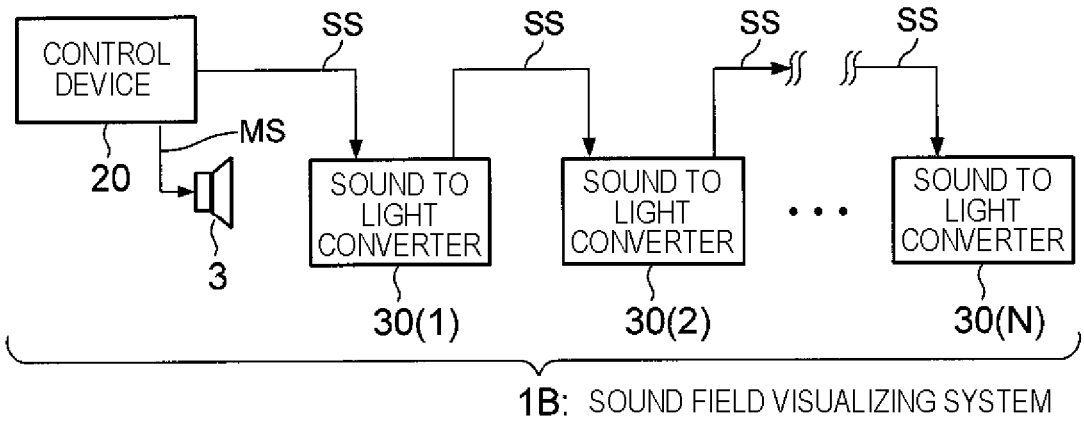
FIG. 7 is a diagram illustrating a configuration example of a sound field visualizing system 1B including a sound to light converter 30(*k*) according to a third embodiment of the present invention.

FIG. 7 is a diagram illustrating a configuration example of a sound field visualizing system 1B including sound to light converters 30(*k*) according to a third embodiment of the present invention. The sound field visualizing system 1B is different from the sound field visualizing system 1A in that the sound to light converters 10(*k*) are replaced with the sound to light converters 30(*k*). Also, as is apparent from FIG. 7, the sound field visualizing system 1B is different from the sound field visualizing system 1A in that the control device 20 and the sound to light converters 30(*k*) are connected to each other in a so-called daisy chain mode so that a sound to light converter 30(1) receives the strobe signal SS from the control device 20, and the sound to light converter 30(*k*: K=2 to N) receives the strobe signal SS from the sound to light converter 30(*k*−1). Hereinafter, the sound to light converters 30(*k*) that are different from those in the second embodiment will be mainly described.

Figure 8A:
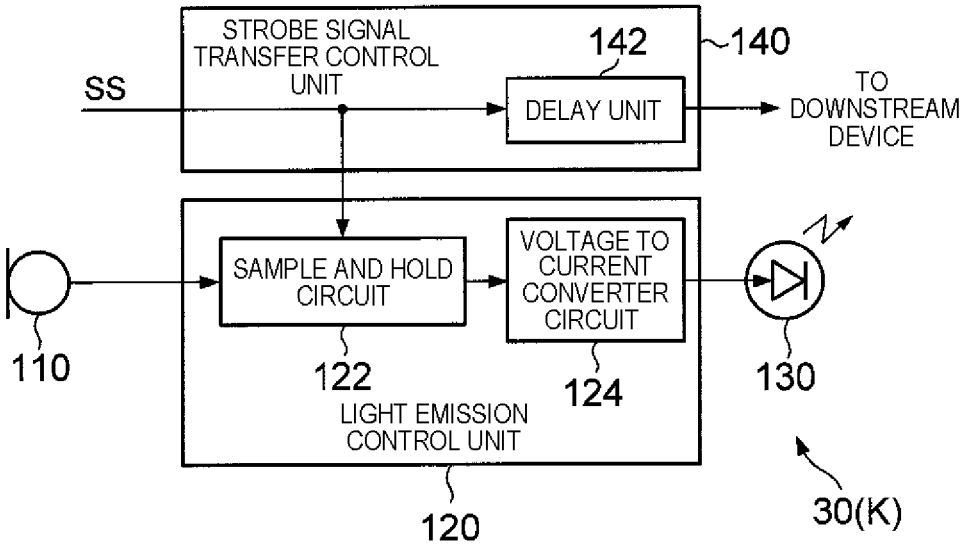
FIGS. 8A and 8B are diagrams illustrating configuration examples of the sound to light converter 30(*k*).

FIG. 8A is a diagram illustrating a configuration example of each sound to light converter 30(*k*). As is apparent from comparison of FIG. 8A with FIG. 2, the sound to light converter 30(*k*) is different from the sound to light converter 10(*k*) in the provision of a strobe signal transfer control unit 140. As illustrated in FIG. 8A, the strobe signal transfer control unit 140 supplies the strobe signal SS given from the external to the light emission control unit 120, and also transfers the strobe signal SS to a downstream device (another sound to light converter 30(*k*) in this embodiment) through a delay unit 142. The delay unit 142 is configured by, for example, plural stages of shift registers, and delays the supplied strobe signal SS according to the number of shift register stages.

Figure 8B:
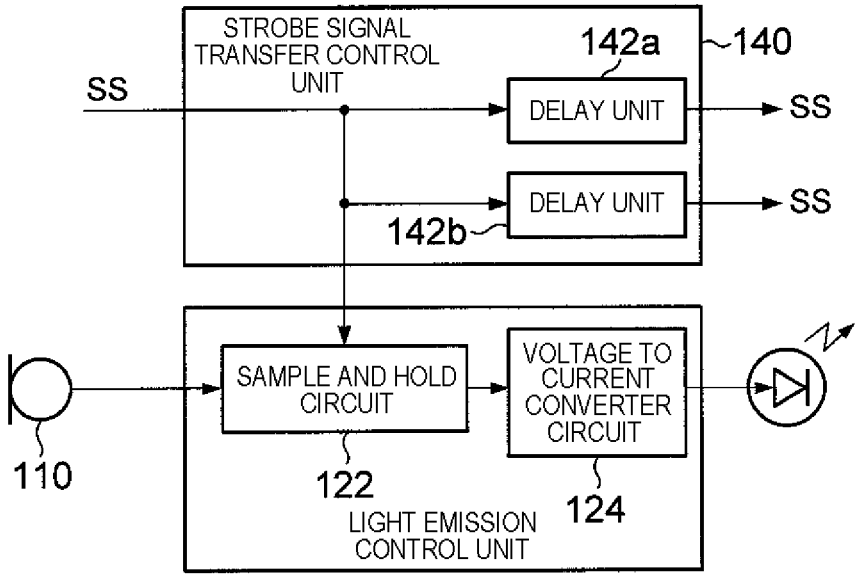

FIG. 8A exemplifies a configuration in which the strobe signal SS received from the external is transferred to one downstream device, but may be transferred to plural downstream devices. For example, when the strobe signal SS is transferred to two downstream devices, as illustrated in FIG. 8B, two delay units (142*a* and 142*b*) are disposed in the strobe signal transfer control unit 140. The strobe signal transfer control unit 140 may execute processing in which the strobe signal SS supplied to the sound to light converter 30(*k*) from the external is divided into three signals, in which one signal is supplied to the light emission control unit 120, and other two signals are transferred to the respective different downstream devices through the respective delay units 142*a* and 142*b*.

Figure 9A:
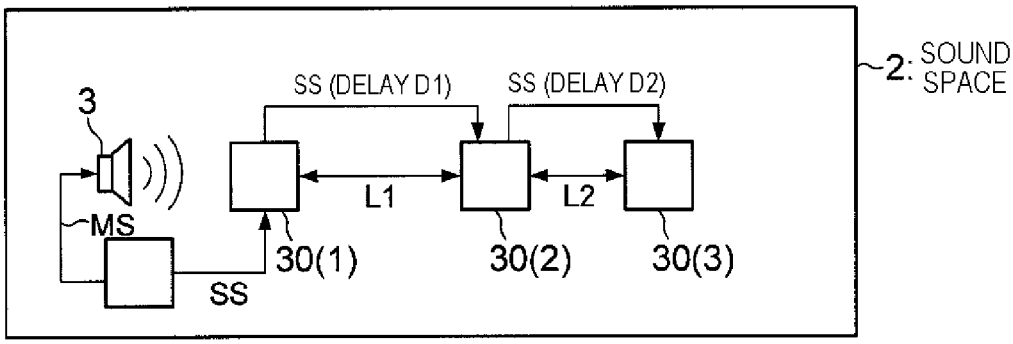
FIGS. 9A to 9C are diagrams illustrating usage examples of the sound field visualizing system 1B.
Figure 9B:
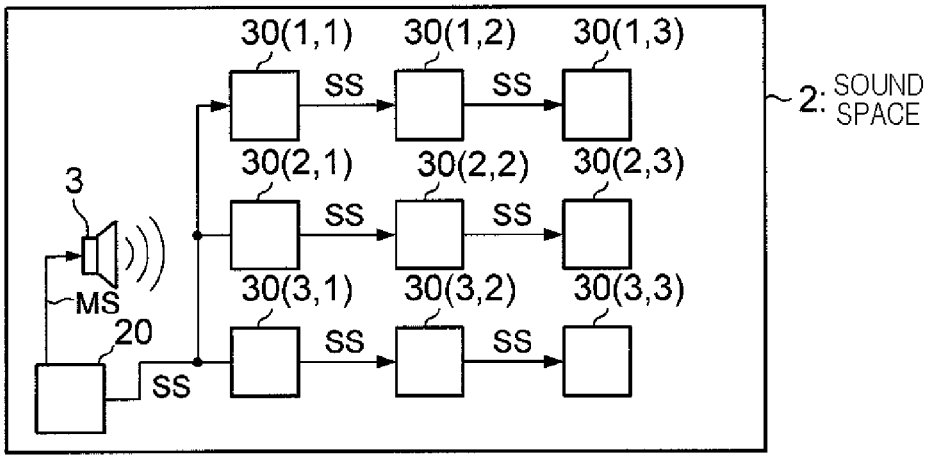
Figure 9C:
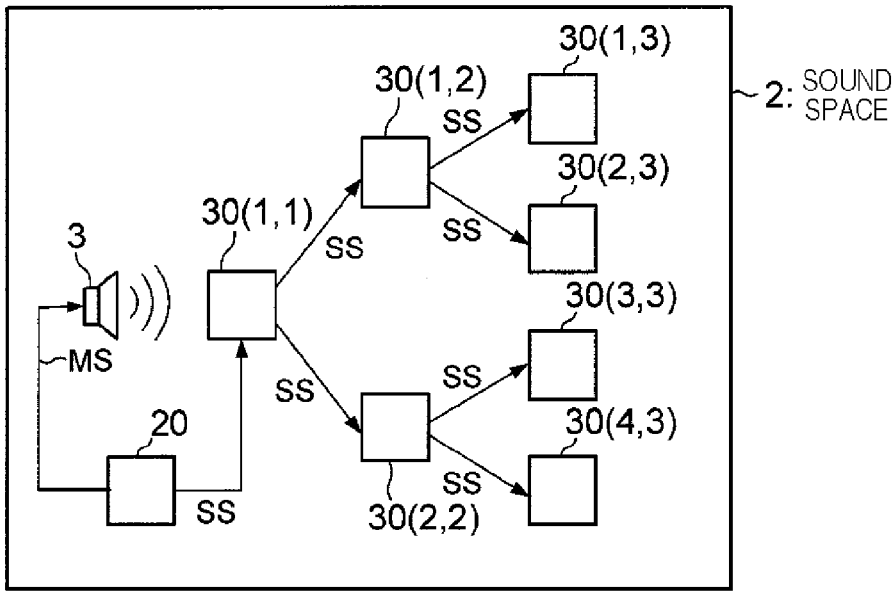

For example, when there is a need to one-dimensionally arrange the sound to light converters 30(*k*) as illustrated in FIG. 9A, or to arrange the sound to light converters 30(*k*) in a matrix as illustrated in FIG. 9B, it is preferable that the sound field visualizing system 1B is configured by the sound to light converters 30(*k*) having the configuration illustrated in FIG. 8A. When there is a need to array the sound to light converters 30(*k*) in a triangle as illustrated in FIG. 9C, it is preferable that the sound field visualizing system 1B is configured by the sound to light converters 30(*k*) having the configuration illustrated in FIG. 8B. This is because wiring of the signal lines between the sound to light converters, and calculation of the delay time are facilitated.

Subsequently, a description will be given of the usage example of the sound field visualizing system 1B according to this embodiment.

As described above, the sound to light converters 30(*k*) included in the sound field visualizing system 1B according to this embodiment are different from the sound to light converters 10(*k*) in that the strobe signal SS generated by the control device 20 is transferred in the daisy chain mode, and the strobe signal SS is delayed by the delay unit 142 in transferring the strobe signal SS. With this different configuration, this embodiment obtains the advantages different from those in the second embodiment.

For example, as illustrated in FIG. 9A, the sound to light converters 30(1), 30(2), and 30(3) are one-dimensionally arrayed so that distances from the sound source 3 thereto are gradually longer. A delay time D1 caused by the delay unit 142 in the sound to light converter 30(1) is set as a value (value obtained by dividing the interval L1 by the sound speed V) corresponding to an interval L1 between the sound to light converter 30(1) and the sound to light converter 30(2). A delay time D2 caused by the delay unit 142 in the sound to light converter 30(2) is set as a value corresponding to an interval L2 between the sound to light converter 30(2) and the sound to light converter 30(3). As a result, the propagation state of one wave front of the sound wave emitted from the sound source 3 can be visualized. Also, in the mode where the sound to light converters 30(*k*) are two-dimensionally arrayed, like the directivity control in the microphone array of a so-called delay control system, the delay time of the delay unit 142 in each sound to light converter 30(*k*) is adjusted, thereby enabling such a directivity control for visualizing the propagation state of the sound arriving from a specific direction to be conducted. According to the mode in which the above directivity control is conducted, the plural sound sources 3 are installed within the sound space 2, the drive control of those sound sources 3 is conducted by the control device 20, and the respective sound sources 3 emit the sound toward a given service area within the sound space 2. In this case, if the respective sound to light converters 30(*k*) are installed within the service area, and the plural sound sources 3 are driven one by one, the propagation state of the sound emitted from the respective sound sources 3 toward the service area can be visualized for each of the sound sources 3.

The third embodiment of the present invention is described above. The delay unit 142 is not always essential, but may be omitted. This is because even if the delay unit 142 is omitted, the same advantages as those in the sound field visualizing system of the second embodiment are obtained.

D: Fourth Embodiment

Figure 10:
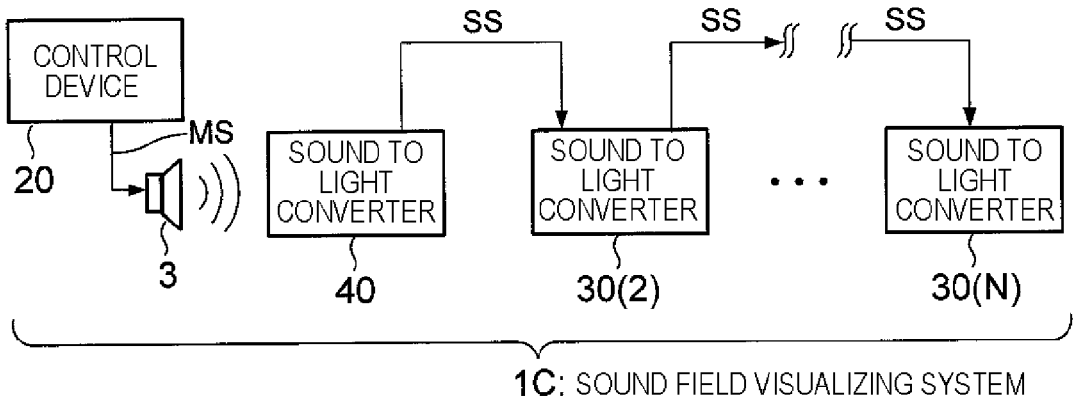
FIG. 10 is a diagram illustrating a configuration example of a sound field visualizing system 1C including a sound to light converter 40 according to a fourth embodiment of the present invention.

FIG. 10 is a diagram illustrating a configuration example of a sound field visualizing system 1C including a sound to light converter 40 according to a fourth embodiment of the present invention. As is apparent from comparison of FIG. 10 with FIG. 7, the sound field visualizing system 1C is different from the sound field visualizing system 1B in that the sound to light converter 30(1) is replaced with the sound to light converter 40, and the sound to light converter 40 is not connected to the control device 20. Hereinafter, the sound to light converter 40 that is different from the second embodiment will be mainly described.

Figure 11:
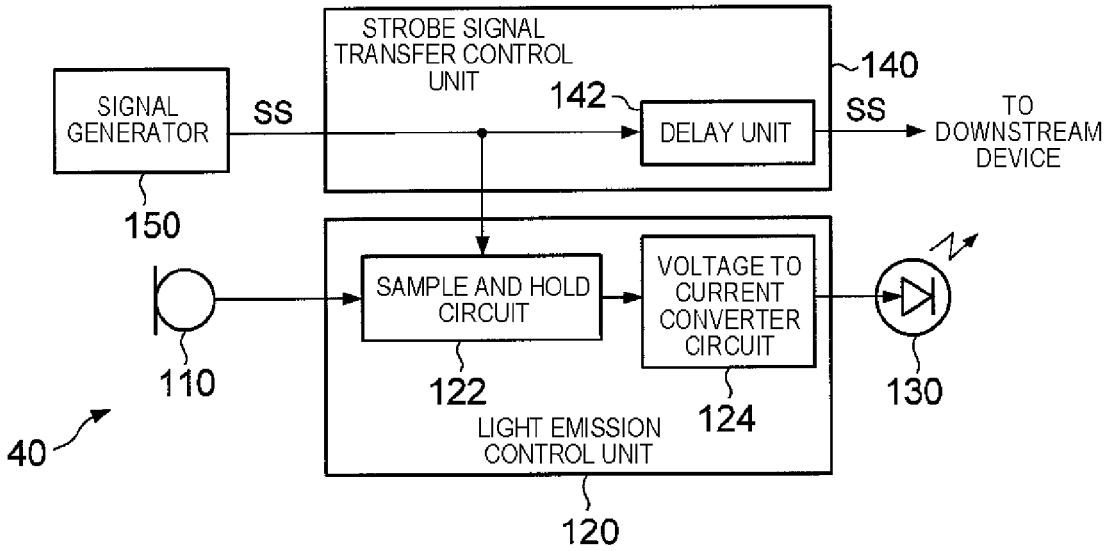
FIG. 11 is a diagram illustrating a configuration example of the sound to light converter 40.

FIG. 11 is a diagram illustrating a configuration example of the sound to light converter 40. As illustrated in FIG. 11, the sound to light converter 40 is different from the sound to light converter 30(*k*) in that there is provided a signal generator 150 that generates a square wave signal, and that the square wave signal generated by the signal generator 150 is supplied to the light emission control unit 120 as the strobe signal SS. In more detail, in the sound to light converter 40, the signal generator 150 is allowed to generate the strobe signal SS at the moment that the sound pressure (or the sound pressure of a specific frequency component) of the sound collected by the microphone 110 exceeds a given threshold value. As a result, the strobe signal SS is generated in synchronization with the emission of the sound to be visualized. Alternatively, a pitch extracting process for extracting the signal component having a given pitch from the output signal of the microphone 110 may be executed by the signal generator 150 to use a signal obtained through the pitch extracting process as the strobe signal SS. With the provision of the signal generator 150, in the sound field visualizing system illustrated in FIG. 10, the sound to light converter 40 is not connected to the control device 20. According to this embodiment, the strobe signal SS can be generated in synchronization with the emission of the sound to be visualized. The strobe signal SS allows the sound to light converter 40 and the sound to light converter 30(*k*) to execute a process in which the instantaneous value of the sound to be visualized (sound emitted from the sound source 3 according to the drive signal MS) is sampled, and the light emitting unit 130 is allowed to emit light according to the instantaneous value.

In the mode described above, the signal generator 150 is allowed to generate the strobe signal SS at the moment that the sound pressure of the sound collected by the microphone 110 exceeds the given threshold value. However, the present invention is not limited to this configuration. For example, with the use of another physical quantity such as temperature, a flow rate, humidity, vibration (transducer), sound, light (ultraviolet rays, infrared rays), electromagnetic waves, radiation, the gravity, or a magnetic field, the strobe signal SS may be generated in the signal generator 150 upon detecting the physical quantity.

E: Fifth Embodiment

Figure 12:
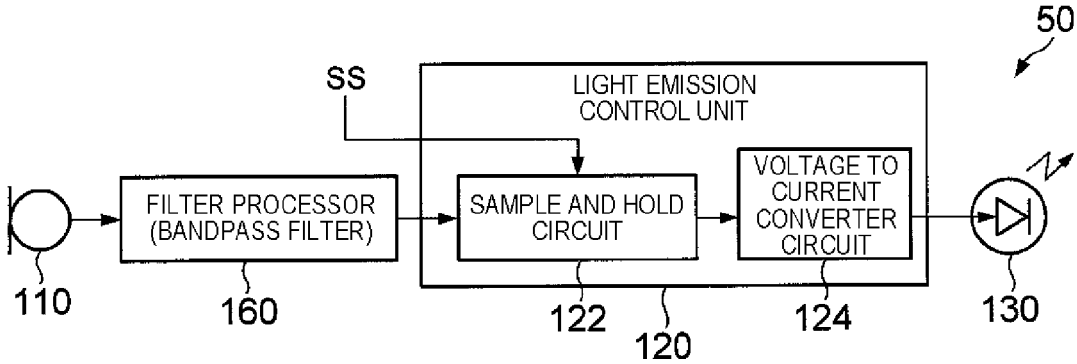
FIG. 12 is a diagram illustrating a configuration example of a sound to light converter 50 according to a fifth embodiment of the present invention.

FIG. 12 is a diagram illustrating a configuration example of a sound to light converter 50 according to a fifth embodiment of the present invention.

As is apparent from comparison of FIG. 12 with FIG. 2, the sound to light converter 50 is different from the sound to light converter 10(*k*) in that a filtering processor 160 is inserted between the microphone 110 and the light emission control unit 120. The filtering processor 160 is configured by, for example, a bandpass filter, and allows only a signal component in a given frequency range (hereinafter referred to as "passing bandwidth") among sound signals output from the microphone 110 to pass therethrough. For that reason, the light emitting unit 130 of the sound to light converter 50 emits light with a luminance level corresponding to the sound pressure of the signal component belonging to the above passing bandwidth among the sound collected by the microphone 110. Accordingly, when the sound to light converter 10(*k*) of the sound field visualizing system 1A in FIG. 1 is replaced with the sound to light converter 50 to visualize the sound field, only the propagation state of the sound having a specific frequency component (that is, a component belonging to the passing bandwidth) can be visualized.

In this way, the following advantages are obtained by visualizing only the propagation state of the specific frequency component among the sound emitted into the sound space. For example, a part (for example, guitar solo or soprano solo) which is a selling feature of a music among plural parts configuring the music is specified by the frequency bandwidth, and only the propagation state of sound of the part is visualized. This enables the user to instinctually and visually grasp whether the sound of that part is propagated over the entire sound space without bias, or not. In general, it is preferable that the part, which is the selling feature of the music, is equally audible at any place of the sound space. Therefore, when the propagation state is biased, there is a need to adjust the layout position of the audio device so as to correct the bias. According to this embodiment, there are advantages in that the propagation state of the sound of the part that is the selling feature of the music is visualized to allow the user to instinctually grasp whether there is a bias or not, and an optimum layout position can be easily found out through trial and error. Also, the sound of a frequency bandwidth (so-called low-frequency sound) lower than an audible range (specifically, a frequency band of from 20 Hz to 20 kHz) is visualized, thereby enabling the propagation status of the low-frequency bandwidth (sound is propagated from any direction) to be grasped. When the user is continuously subjected to the low-frequency sound for a long time, the user may suffer from health hazards such as a headache or dizziness. However, there is a difficulty to specify the sound source as known. If the propagation state of the low-frequency sound is visualized by using the sound to light converter 50 of this embodiment, it is expected that the sound source can be readily specified by tracing the propagation direction.

In the above embodiment, the filtering processor 160 is inserted between the microphone 110 and the light emission control unit 120 in the sound to light converter 10(*k*) illustrated in FIG. 2 to configure the sound to light converter 50. Alternatively, the filtering processor 160 may be inserted between the microphone 110 of the sound to light converter 30(*k*) illustrated in FIG. 8A or the sound to light converter illustrated in FIG. 8B and the light emission control unit 120. Also, the filtering processor 160 may be inserted between the microphone 110 and the light emission control unit 120 in the sound to light converter 40 illustrated in FIG. 11.

F: Sixth Embodiment

Figure 13:
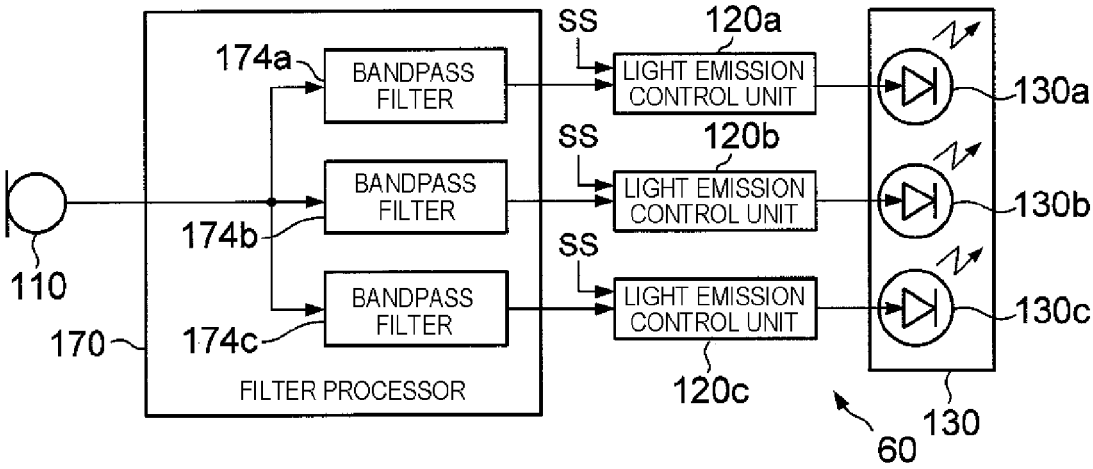
FIG. 13 is a diagram illustrating a configuration example of a sound to light converter 60 according to a sixth embodiment of the present invention.

FIG. 13 is a diagram illustrating a configuration example of a sound to light converter 60 according to a sixth embodiment of the present invention.

The sound to light converter 60 includes the microphone 110, a filtering processor 170, three light emission control units (120*a*, 120*b*, and 120*c*), and the light emitting unit 130 having three light emitters (130*a*, 130*b*, and 130*c*) each emitting light of a different color. For example, the light emitter 130*a* is an LED that emits red light, the light emitter 130*b* is an LED that emits green light, and the light emitter 130*c* is an LED that emits blue light.

In the sound to light converter 60, the sound signal output from the microphone 110 is supplied to the filtering processor 170. As illustrated in FIG. 13, the filtering processor 170 includes bandpass filters 174*a*, 174*b*, and 174*c*, and the sound signal supplied from the microphone 110 to the filtering processor 170 is supplied to the respective three bandpass filters 174*a*, 174*b* and 174*c*. As illustrated in FIG. 13, the bandpass filter 174*a* is connected to the light emission control unit 120*a*, the bandpass filter 174*b* is connected to the light emission control unit 120*b*, and the bandpass filter 174*c* is connected to the light emission control unit 120*c*.

The bandpass filters 174*a*, 174*b*, and 174*c* each have a passing bandwidth that does not overlap with each other. More specifically, the bandpass filter 174*a* has a high frequency band side (for example, a frequency bandwidth of from 4 kHz to 20 kHz) of the audible range as the passing bandwidth, the bandpass filter 174*c* has a low frequency band side (a frequency bandwidth of from 20 Hz to 1 kHz) of the audible range as the passing bandwidth, and the bandpass filter 174*b* has a frequency bandwidth (hereinafter referred to as "intermediate bandwidth") therebetween as the passing bandwidth. For that reason, the bandpass filter 174*a* allows only a signal component of the high frequency band to pass therethrough to supply the signal component to the light emission control unit 120*a*. Likewise, the bandpass filter 174*b* allows only a signal component of the intermediate frequency band to pass therethrough to supply the signal component to the three light emission control unit 120*b*. The bandpass filter 174*c* allows only a signal component of the low frequency band to pass therethrough to supply the signal component to the three light emission control unit 120*c*. That is, the bandpass filters 174*a*, 174*b*, and 174*c* function as bandwidth division filters that divide the bandwidth of the output signal from the microphone 110.

As illustrated in FIG. 13, the light emission control unit 120*a* is connected to the light emitter 130*a*, the light emission control unit 120*b* is connected to the light emitter 130*b*, and the light emission control unit 120*c* is connected to the light emitter 130*c*. Each of the light emission control units 120*a*, 120*b*, and 120*c* has the same configuration as that of the light emission control unit 120 (refer to FIG. 2) of the sound to light converter 10(*k*), and controls the light emission of the light emitter connected thereto. For example, the light emission control unit 120*a* samples the sound signal supplied from the bandpass filter 174*a* in synchronization with the rising edge (or the falling edge) of the strobe signal SS, and allows the light emitter 130*a* to emit light with a luminance level corresponding to the sampled instantaneous value. Likewise, the light emission control unit 120*b* samples the sound signal supplied from the bandpass filter 174*b* in synchronization with the rising edge (or the falling edge) of the strobe signal SS, and allows the light emitter 130*b* to emit light with a luminance level corresponding to the sampled instantaneous value. The light emission control unit 120*c* samples the sound signal supplied from the bandpass filter 174*c* in synchronization with the rising edge (or the falling edge) of the strobe signal SS, and allows the light emitter 130*c* to emit light with a luminance level corresponding to the sampled instantaneous value.

As described above, the bandpass filters 174*a* allows only the signal component of the high frequency band to pass therethrough, the bandpass filters 174*b* allows only the signal component of the intermediate frequency band to pass therethrough, and the bandpass filters 174*c* allows only the signal component of the low frequency band to pass therethrough. For that reason, the light emitter 130*a* of the sound to light converter 60 emits the light with a luminance level corresponding to the sound pressure of the high frequency component of the sound collected by the microphone 110, the light emitter 130*b* emits the light with a luminance level corresponding to the sound pressure of the intermediate frequency component thereof, and the light emitter 130*c* emits the light with a luminance level corresponding to the sound pressure of the low frequency component thereof. Accordingly, when the sound collected by the microphone 110 is a so-called white noise (that is, sound uniformly including the respective signal components from the low frequency band to the high frequency band), the light emitters 130*a*, 130*b*, and 130*c* of the sound to light converter 60 emit the lights of red, green, and blue with substantially the same luminance, respectively. A synthetic light of those lights is observed as a white light. On the contrary, when the sound collected by the microphone 110 is high in the signal component at the high frequency side, the synthetic light is observed as a reddish light. Conversely, when the sound is high in the signal component at the low frequency side, the synthetic light is observed as a bluish light. For that reason, the sound field visualizing system is configured by using the sound to light converter 60 (specifically, all of the sound to light converters 10(*k*) in FIG. 1 are replaced with the sound to light converter 60 to configure the sound field visualizing system). The drive signal MS for allowing the sound source 3 to output the white noise as the sound to be visualized is supplied to the sound source 3 from the control device 20. The propagation state of the sound (that is, white noise) emitted from the sound source 3 is visualized by using the sound field visualizing system. With the above configuration, it can be grasped whether the respective frequency components are uniformly propagated into the sound space, or not.

As described above, according to this embodiment, the propagation state of the sound emitted into the sound space, and whether the respective frequency components of that sound are uniformly propagated, or not, can be readily visualized. In this embodiment, the light emitting unit 130 is configured by the three light emitters different in emission color from each other. However, the light emitting unit 130 may be configured by 2 or 4 or more light emitters different in emission color from each other. Also, in this embodiment, it is determined whether the respective frequency components are uniformly propagated into the sound space, or not, on the basis of whether the synthetic light of the lights emitted from the respective light emitters 130*a*, 130*b*, and 130*c* is the white light, or not. However, when the uniform propagation of the sound of the high frequency band (or low frequency band) has priority over another frequency component, it may be determined whether the sound of the high frequency band (or lower frequency band) is uniformly propagated into the sound space, or not, on the basis of whether the synthetic light is reddish (bluish) more than the white light, or not.

Figure 14:
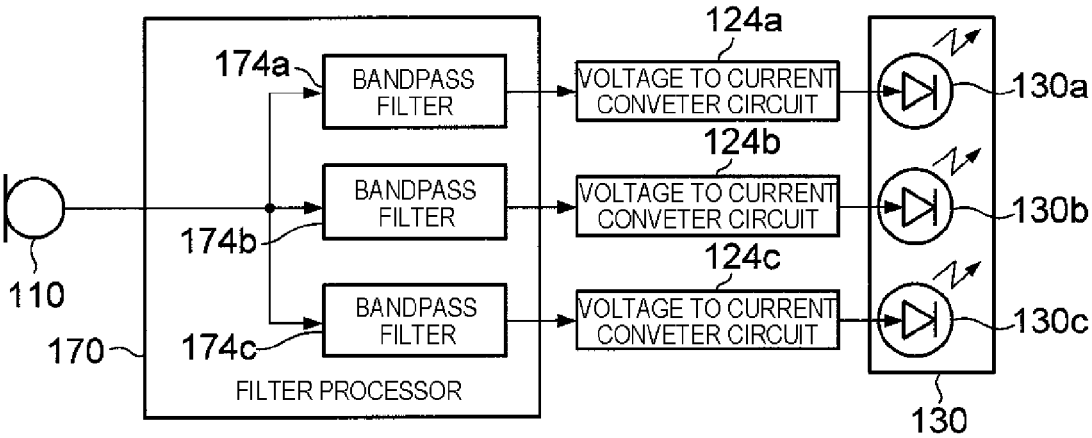
FIG. 14 is a diagram illustrating a modified example of the sound to light converter 60.

In the above-described sixth embodiment, the propagation state of the sound emitted into the sound space is visualized for each bandwidth component of the sound. However, when there is only a need to grasp only the sound pressure distribution of the respective bandwidth components in the sound space, the voltage to current converter circuits 124*a*, 124*b*, and 124*c* may be inserted between the filtering processor 170 and the light emitting unit 130 as illustrated in FIG. 14 (in other words, the sample and hold circuit 122 is omitted from each of the light emission control units 120*a*, 120*b*, and 120*c*) to configure the sound to light converter. Also, the strobe signal transfer control unit 140 may be disposed in the sound to light converter illustrated in FIG. 13 or 14, and the signal generator 150 may be also provided.

G: Seventh Embodiment

Figure 15:
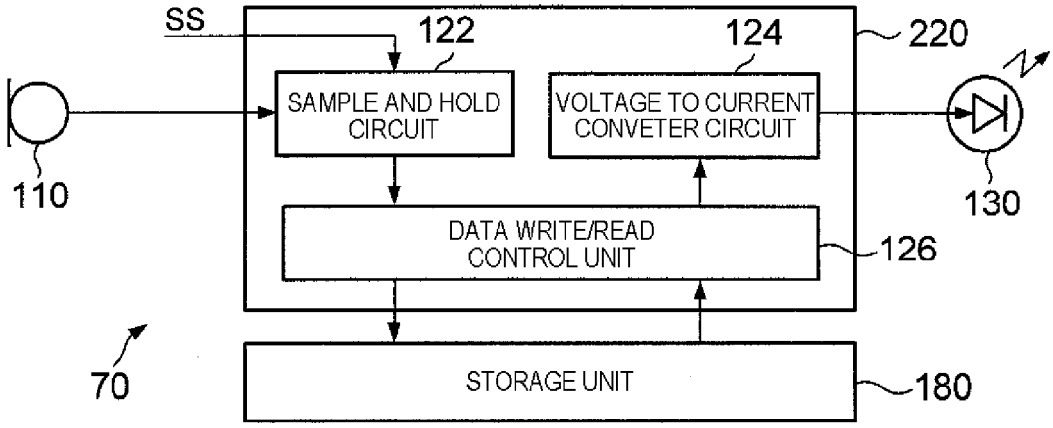
FIG. 15 is a diagram illustrating a configuration example of a sound to light converter 70 according to a seventh embodiment of the present invention.

FIG. 15 is a diagram illustrating a configuration example of a sound to light converter 70 according to a seventh embodiment of the present invention.

As is apparent from comparison of FIG. 15 with FIG. 1, the sound to light converter 70 is different from the sound to light converter 10(*k*) in that there is provided a storage unit 180, and that the light emission control unit 120 is replaced with a light emission control unit 220. The storage unit 180 may be configured by a volatile memory such as a RAM (random access memory), or may be configured by a nonvolatile memory such as a flash memory. The light emission control unit 220 is different from the light emission control unit 120 in that a data write/read control unit 126 is provided in addition to the sample and hold circuit 122 and the voltage to current converter circuit 124. The data write/read control unit 126 starts a process of sequentially writing data indicative of the instantaneous value held by the sample and hold circuit 122 upon receiving an external signal for instructing a data write start. The data write/read control unit 126 also executes a process of sequentially reading the data in a written order in the same cycle as the cycle of the strobe signal SS upon receiving an external signal for instructing a data read start (or when the data stored in the storage unit 180 reaches a given amount, or the input of the strobe signal SS is stopped for a given time), and applying a voltage corresponding to the instantaneous value indicated by the data to the voltage to current converter circuit 124.

With the above configuration, according to the sound to light converter 70 of this embodiment, for example, when the steady sound (sound having a sound waveform represented by a sinusoidal wave of the cycle Tf as illustrated in FIG. 3A) is emitted from the sound source 3, the propagation state of the sound from an arbitrary time (that is, a time when the external signal for instructing the data write start is supplied) can be recreated in an ex-post manner with the use of the strobe signal SS of the cycle Tss (≠Tf). For example, when the frequency of the sound emitted from the sound source 3 is 500 Hz, the sound of the frequency 499 Hz may be used as the strobe signal SS. Also, as illustrated in FIG. 4A or 5B, the same advantages are obtained even if the strobe signal SS having the rising interval gradually lengthened is used.

Alternatively, the sample and hold circuit 122 may conduct sampling with a high time resolution upon receiving the external signal for instructing the data write start. The data write/read control unit 126 may conduct a process of writing the sampled result in the storage unit 180. The data write/read control unit 126 may execute a process of sequentially reading the data in the written order in a cycle longer than the cycle of write (for example, cycle having a time length 1000 times as large as the cycle of write) upon receiving the external signal for instructing the data read start (or when the data stored in the storage unit 180 reaches the given amount), and applying the voltage corresponding to the instantaneous value indicated by each data to the voltage to current converter circuit 124. According to this configuration, the propagation state of the sound emitted from the sound source 3 into the sound space from the arbitrary time can be recorded in more detail, and the recorded contents can be played in slow motion. When the sample and hold circuit 122 conducts sampling with the high time resolution, it is desirable that the sampling cycle is sufficiently shortened so as to satisfy sampling theorem. The function of the external signal for instructing the data write start (read start) may be allocated to the strobe signal SS.

H: Modifications

The first to seventh embodiments of the present invention have been described above. Those embodiments may be modified as follows.

(1) In the above embodiments, how luminance the light emitters of the sound to light converters arrayed at the respective different positions within the sound space emit the light with is visually observed to allow the user to grasp the propagation state of the sound wave in the sound space. However, the appearance of the light emission of the respective light emitters may be imaged by a general video camera and recorded. In this situation, even if in application (intended purpose, method) where even if the appearance of the light emission cannot be observed on the spot, the recorded appearance may be observed, the use of an invisible light LED such as an infrared LED is conceivable.

(2) In the above embodiments, the transmission of the strobe signal SS between the control device 20 and the sound to light converters is conducted by a wired communication. Alternatively, the transmission of the strobe signal SS may be conducted by a wireless communication. Also, a GPS receiver may be disposed in each of the sound to light converters so that the strobe signal is generated in each of the sound to light converters on the basis of absolute time information received by the GPS receiver. Also, in the mode where the strobe signal SS is transmitted in the daisy chain mode, it is conceivable that the light emitted by the light emitting unit 130 is used as the strobe signal SS. Also, in the mode where the strobe signal transfer control unit 140 is disposed in the sound to light converter 50, data indicative of the passing bandwidth of the filtering processor 160 is allocated to the strobe signal SS, and the strobe signal SS is transferred to a downstream device. In the downstream device, the passing bandwidth of the filtering processor 160 may be set according to the data allocated to the strobe signal SS. According to this mode, there is no need to set the passing bandwidth for all of the sound to light converters included in the sound field visualizing system, and time and effort of the setting work can be omitted.

(3) In the above embodiments, a case in which the direct sound emitted from the sound source 3 has been described. Alternatively, a reflected sound from a wall or a ceiling of the sound space 2 may be visualized. In visualizing the indirect sound, the sound field visualizing system 1C is preferable. More specifically, the signal generator 150 of the sound to light converter 40 conducts the following process. That is, the signal generator 150 executes the process in which local peaks at which the sound pressure of the sound collected by the microphone 110 changes from rising to falling are detected, and the strobe signal SS is output upon detecting a second (or second or subsequent) local peak. The reason that the signal generator 150 generates the strobe signal SS upon detection of the second (or second or subsequent) local peak is that it is conceivable that a first local peak corresponds to the direct sound, and the second and subsequent local peaks correspond to the indirect sound such as a primary reflected sound.

(4) In the above embodiments, the light emitting element such as an LED is used as the light emitter to configure the light emitting unit 130. However, a light bulb (or a light bulb to which a colored cellophane tape is adhered) or a neon bulb may be used as the light emitter. It is preferable to use the light emitting element such as the LED from the viewpoints of the reaction rate or the power consumption.

(5) In the above respective embodiments, the voltage value output from the sample and hold circuit 122 is converted into a current of the current value proportional to the voltage value by the voltage to current converter circuit 124, and supplied to the light emitting unit 130. As a result, the sound pressure of the sound collected by the microphone 110 and the linearity of the light emission luminance of the light emitting unit 130 are secured. However, when such linearity is not required, the voltage to current converter circuit 124 may be omitted. Also, it is more preferable that the voltage to current converter circuit 124 is replaced with a PWM modulator circuit or a PDM modulator circuit. It is conceivable that the PWM modulator circuit and the PDM modulator circuit are configured as is well known. Also, in the mode where the voltage to current converter circuit 124 is replaced with the PWM modulator circuit or the PDM modulator circuit, it is preferable that an A/D converter is disposed upstream of the PWM modulator circuit or the PDM modulator circuit. Also, in the above embodiments, the sample and hold circuit 122 is used to sample and hold the instantaneous value of the output signal of the microphone 110. However, the sample and hold circuit 122 may be omitted, the instantaneous value of the output signal of the microphone 110 may be acquired in synchronization with the strobe signal SS, and the light emitting unit 130 may emit the light with a luminance level corresponding to the acquired result. Also, the output signal of the microphone 110 may be always supplied to the voltage to current converter circuit 124. Also, the output signal of the microphone 110 may be supplied to the voltage to current converter circuit 124 to allow the light emitting unit 130 to emit the light at the moment that the signal intensity of the output signal of the microphone 110 exceeds a given threshold value.

(6) In the above embodiments except for the fourth embodiment, a case in which the control device 20 generates the strobe signal SS has been described. However, the present invention is not limited to this configuration. That is, like the sound to light converter 40 in the fourth embodiment, the strobe signal SS may be generated by one of the plural sound to light converters as in the other embodiments.

What is claimed is:

1. A sound field visualizing system comprising:

a plurality of sound to light converters each comprising:

a microphone;

a light emitting unit; and a light emission control unit configured to:

acquire an instantaneous value of an output signal from the microphone in synchronization with a rising edge or a falling edge of a strobe signal; and allow the light emitting unit to emit light with a luminance level corresponding to the acquired instantaneous value; and a control device configured to:

generate and output the strobe signal in synchronization with an emission of sound to be visualized by the plurality of sound to light converters; and change a rising interval or a falling interval of the strobe signal with a lapse of time.

2. The sound field visualizing system according to claim 1, wherein the strobe signal is a square wave signal.

3. The sound field visualizing system according to claim 1, wherein the sound light converter further includes a filtering processor configured to filter the output signal from the microphone and to supply the filtered signal to the light emission control unit.

4. The sound field visualizing system according to claim 3, wherein:

the plurality of light emitters emits lights in different colors, the filter processor includes a bandwidth division filter configured to divide the output signal from the microphone into bandwidth components, each component corresponding to respective one of the plurality of light emitters, and the light emission control unit is configured to acquire the instantaneous value for each bandwidth component divided by the filter processor, and to allow each of the plurality of light emitters to emit light with a luminance level corresponding to the instantaneous value in the bandwidth component corresponding to the each of the plurality of light emitters.

5. The sound field visualization system according to claim 1, further comprising a signal generator configured to:

extract pitch information from the signal output from the microphone; and generate the strobe signal based on the extracted pitch information.

6. A sound field visualizing system comprising:

a plurality of sound to light converters each comprising:

a microphone;

a light emitting unit; and a light emission control unit configured to:

acquire an instantaneous value of an output signal from the microphone in synchronization with a rising edge or a falling edge of a strobe signal; and allow the light emitting unit to emit light with a luminance level corresponding to the acquired instantaneous value; and a control device configured to:

generate and output the strobe signal in synchronization with an emission of sound to be visualized by the plurality of sound to light converters; and change a rising interval or a falling interval of the strobe signal in response to an operation by a user.

7. The sound field visualizing system according to claim 6, wherein the strobe signal is a square wave signal.

8. The sound field visualizing system according to claim 6, wherein the sound to light converter further includes a transfer control unit configured to delay the strobe signal by a predetermined time and to transfer the delayed strobe signal to one or more of other sound to light converters.

9. The sound field visualizing system according to claim 8, wherein the control device is configured to:

generate the strobe signal in synchronization with an emission of sound to be visualized by the plurality of sound to light converters; and output the generated strobe signal to one or more of the plurality of sound to light converters.

10. The sound field visualizing system according to claim 6, wherein the sound light converter further includes a filtering processor configured to filter the output signal from the microphone and to supply the filtered signal to the light emission control unit.

11. The sound field visualizing system according to claim 10, wherein:

the plurality of light emitters emits lights in different colors, the filter processor includes a bandwidth division filter configured to divide the output signal from the microphone into bandwidth components, each component corresponding to respective one of the plurality of light emitters, and the light emission control unit is configured to acquire the instantaneous value for each bandwidth component divided by the filter processor, and to allow each of the plurality of light emitters to emit light with a luminance level corresponding to the instantaneous value in the bandwidth component corresponding to the each of the plurality of light emitters.

12. The sound field visualization system according to claim 6, further comprising a signal generator configured to:

extract pitch information from the signal output from the microphone; and generate the strobe signal based on the extracted pitch information.

13. A sound field visualizing system comprising:

a plurality of sound to light converters each comprising:

a microphone;

a light emitting unit;

a storage unit; and a light emission control unit configured to:

acquire an instantaneous value of an output signal from the microphone in synchronization with a strobe signal;

perform a first task of sequentially writing data indicative of the instantaneous value of the output signal from the microphone into the storage unit;

perform a second task of sequentially reading the data stored in the storage unit in synchronization with the strobe signal or in a cycle longer than a writing cycle in the task; and allow the light emitting unit to emit light with a luminance level corresponding to the instantaneous value indicated by the read data.

14. The sound field visualizing system according to claim 1, wherein the sound to light converter further includes a transfer control unit configured to delay the strobe signal by a predetermined time and to transfer the delayed strobe signal to one or more of other sound to light converters.

15. The sound field visualizing system according to claim 14, wherein the control device is configured to:

generate the strobe signal in synchronization with an emission of sound to be visualized by the plurality of sound to light converters; and output the generated strobe signal to one or more of the plurality of sound to light converters.

16. The sound field visualizing system according to claim 13, wherein the sound to light converter further includes a transfer control unit configured to delay the strobe signal by a predetermined time and to transfer the delayed strobe signal to one or more of other sound to light converters.

17. The sound field visualizing system according to claim 16, wherein the control device is configured to:

generate the strobe signal in synchronization with an emission of sound to be visualized by the plurality of sound to light converters; and output the generated strobe signal to one or more of the plurality of sound to light converters.

18. The sound field visualizing system according to claim 13, wherein the sound light converter further includes a filtering processor configured to filter the output signal from the microphone and to supply the filtered signal to the light emission control unit.

19. The sound field visualizing system according to claim 18, wherein:

the plurality of light emitters emits lights in different colors, the filter processor includes a bandwidth division filter configured to divide the output signal from the microphone into bandwidth components, each component corresponding to respective one of the plurality of light emitters, and the light emission control unit is configured to acquire the instantaneous value for each bandwidth component divided by the filter processor, and to allow each of the plurality of light emitters to emit light with a luminance level corresponding to the instantaneous value in the bandwidth component corresponding to the each of the plurality of light emitters.

20. The sound field visualization system according to claim 13, further comprising a signal generator configured to:

extract pitch information from the signal output from the microphone; and generate the strobe signal based on the extracted pitch information.

* * * * *